US007607798B2

(12) United States Patent
Panotopoulos

(10) Patent No.: US 7,607,798 B2
(45) Date of Patent: Oct. 27, 2009

(54) LED LIGHTING UNIT

(75) Inventor: George Panotopoulos, Palo Alto, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 122 days.

(21) Appl. No.: 11/527,251

(22) Filed: Sep. 25, 2006

(65) Prior Publication Data

US 2008/0074872 A1 Mar. 27, 2008

(51) Int. Cl.
*F21S 9/00* (2006.01)
*F21V 33/00* (2006.01)

(52) U.S. Cl. ..... 362/233; 362/276; 362/231; 362/234; 362/253; 362/249

(58) Field of Classification Search ..... 362/464, 362/276, 802, 800, 227, 231, 233, 234, 253, 362/394, 251, 249
See application file for complete search history.

(56) References Cited

U.S. PATENT DOCUMENTS 3,678,286 A * 7/1972 Willis ..... 307/38
4,143,368 A * 3/1979 Route et al. ..... 340/543
5,633,629 A * 5/1997 Hochstein ..... 340/907
6,443,604 B1 * 9/2002 Rudenberg ..... 362/488
2005/0024877 A1 * 2/2005 Frederick ..... 362/277
2005/0122064 A1 * 6/2005 Chevalier et al. ..... 315/291
2005/0195600 A1 * 9/2005 Porchia et al. ..... 362/240
2006/0268544 A1 * 11/2006 Rains Jr. et al. ..... 362/231
2006/0285325 A1 * 12/2006 Ducharme et al. ..... 362/231
2007/0247414 A1 * 10/2007 Roberts ..... 345/102

* cited by examiner

*Primary Examiner*—Jacob Y Choi

(57) ABSTRACT

A lighting unit having a light generation section, a light analysis section, a controller, and a first communication interface is disclosed. The light generation section and the light analysis section are housed in a housing having a transparent window. The light generating section includes a plurality of groups of LEDs, each group emitting light of a different spectrum than the other groups. The light analysis section generates intensity signals related to the intensity of light generated by each of the groups and the intensity of light originating from a location outside the housing. The controller adjusts a current through each of the LEDs in response to the intensity signals. The first communication interface is utilized by the controller to communicate with a device external to the lighting unit for receiving commands during the operation of the lighting unit.

18 Claims, 3 Drawing Sheets

LED LIGHTING UNIT

BACKGROUND OF THE INVENTION

Light-emitting diodes (LEDs) are attractive candidates for the replacement of conventional light sources based on incandescent and fluorescent lights. LEDs have significantly higher power efficiencies than incandescent lights and have much greater lifetimes. In addition, LEDs do not require the high voltage systems associated with fluorescent lights and can provide light sources that more nearly approximate "point sources". The latter feature is particularly important for light sources that utilize collimating or other imaging optics.

LEDs emit light in a relatively narrow spectral band. Hence, to provide a light source of an arbitrary perceived color, the light from a number of LEDs must be combined in a single light fixture or some form of phosphor conversion layer must be used to convert the narrow band light to light having the desired color. While this complicates the construction of some LED light sources, it also provides the basis for light sources having a color that can be varied by altering the ratios of the light emitted by the various colored LEDs or an intensity by varying the power to all of the LEDs. In contrast, conventional light sources based on fluorescent tubes emit light of a fixed color and intensity.

A light source based on a single LED is relatively limited in the amount of light that the light source can generate. Typically, LEDs have power dissipations that are less than a few watts. Hence, to provide a high intensity light source to replace conventional light fixtures, a relatively large number of LEDs must be used in each light source.

In addition, LEDs age with use. Typically, the light output deceases with use and, in some cases, the spectrum emitted by the LED shifts with age giving rise to color shifts. In general, LEDs that emit different colors of light have different aging characteristics, since the aging profile of an LED depends on the fabrication process and materials, as well as other factors. In a light source based on three different color LEDs, the shift in intensity and/or spectrum causes the light emitted by the source to shift in color. To correct for these problems, many LED light sources include some form of photodetector that measures the light generated by the LEDs and adjusts the drive currents to each LED to maintain the desired color.

Most of the effort that has gone into designing LED light sources has been directed to overcoming the problems discussed above that prevent widespread use of the LED light source as replacements for conventional light sources. While the resultant designs have brought LED light sources closer to realizing their potential as replacements for conventional light sources, these devices have failed to take advantage of many of the other features inherent in LED light sources.

SUMMARY OF THE INVENTION

The present invention includes a lighting unit having a light generation section, a light analysis section, a controller, and a first communication interface. The light generation section and the light analysis section are housed in a housing having a transparent window. The light generating section includes a plurality of groups of LEDs, each group emitting light of a different spectrum than the other groups. At least one of the groups includes a plurality of LEDs. The light analysis section generates an intensity signal related to the intensity of light generated by each of the groups. The controller adjusts a current through each of the LEDs in response to the intensity signals. The first communication interface is utilized by the controller to communicate with a device external to the lighting unit for receiving commands and/or transmitting information during the operation of the lighting unit. The light analysis section also generates an ambient intensity signal related to the intensity of light originating from a location outside of the housing. In one aspect of the invention, the controller can alter the current through one of the LEDs in response to a change in the ambient intensity signal to compensate for changes in the ambient light.

In another aspect of the invention, one of the groups can include a spare LED that emits light in the spectrum of that group. When the controller detects an LED that is defective in that group, the controller causes the spare LED to be connected in place of the defective LED.

In another aspect of the invention, the controller sends information on the first communications interface specifying the ambient light intensity signal.

In yet another aspect of the invention, the first communication interface includes a detector for receiving light signals from outside the housing. The light signals can be provided by a portable command unit that is utilized by a user to send commands to the lighting unit and to program the lighting unit.

DETAILED DESCRIPTION OF THE PREFERRED EMBODIMENTS

Figure 1:
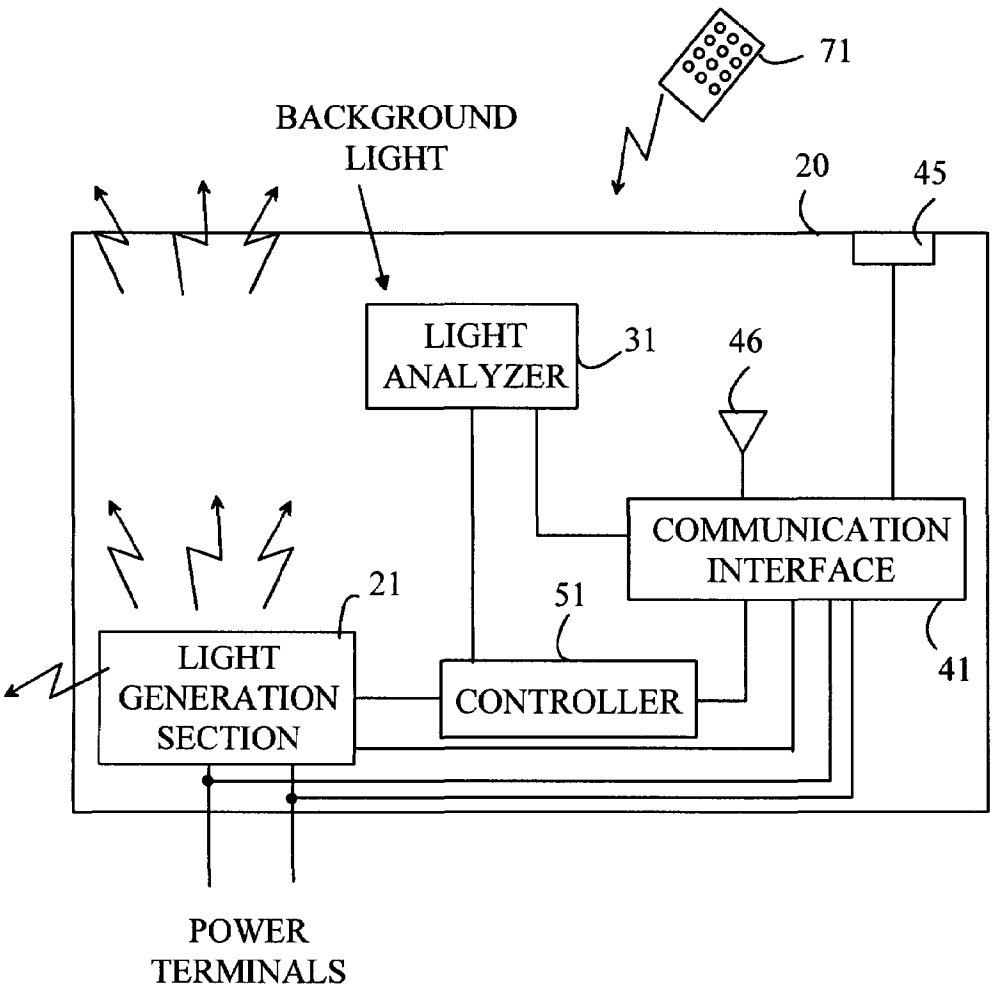
FIG. 1 illustrates an LED lighting unit according to one embodiment of the present invention.

The manner in which the present invention provides its advantages can be more easily understood with reference to FIG. 1, which illustrates an LED lighting unit according to one embodiment of the present invention. LED lighting unit 20 includes a light generation section 21 having a plurality of LEDs, a light analyzer 31 that measures light reaching the analyzer from the LEDs and from the background in which the LED operates, a communication interface 41, and a controller 51.

Figure 2:
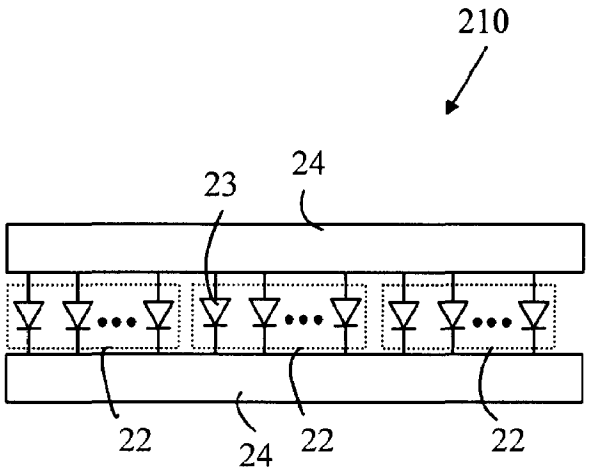
FIG. 2 is a schematic drawing of a light generation section according to one embodiment of the present invention.

Refer now to FIG. 2, which is a schematic drawing of a light generation section according to one embodiment of the present invention. In general, the light generation section 210 includes a plurality of LEDs 23 that can be divided into groups of LEDs 22 in which each LED in a group emits light of the same spectrum, different groups emitting different spectra. The LEDs are powered via driver 24 that will be discussed in more detail below. The number of LEDs in each group is determined by the maximum light of that color that is to be generated by LED lighting unit 20 and the degree of reliability desired for the light source.

In some embodiments of the present invention, spare LEDs are included in each group. If an LED fails in a particular group, one of the spares in that group is activated to replace the failed LED. When the number of spares reaches a predetermined critical point, controller 51 communicates this fact to the user or a central controller so that the light source can be replaced before it completely fails. If the building in which the light source is operating includes a central controller as described below, controller 51 merely sends a message to the controller identifying the light source in question. If no central controller is present, controller 51 could signal the user by altering the output color, blinking when initially turned on, or by strobing or blinking periodically to indicate imminent failure and that the source should be replaced in the near future.

The amount of light generated by each LED per unit time depends on the average current through that LED over the time period in question. The average current can be set by setting a constant current through the LED or by cycling the LED on and off at a frequency that is too fast to be perceived by the eyes of the observers. In the latter case, the current during the "on" periods is set at the maximum desired current, and the average current is set by adjusting the fraction of each cycle during which the LED is turned on. If the spectrum emitted by the LED varies as a function of current through the LED, the latter scheme is preferred, since the current flowing through the LEDs at each light intensity setting is the same, and hence, the spectrum does not change even though the perceived light intensity changes. As will be explained in more detail below, the latter scheme is also better adapted to certain control schemes. It should be noted that, in principle, a control scheme in which a combination of the two strategies could also be utilized.

The amount of light that is to be generated by each LED is determined by the perceived color of light that is to be emitted by LED lighting unit 20 and the intensity of that light. In one embodiment of the present invention, the light generation section will include three groups of LEDs that emit light in the red, green, and blue regions of the spectrum. The perceived color of light generated is determined by the ratios of the intensities of the light from each group of LEDs. It should be noted that other color schemes utilizing more or fewer groups of LEDs could be utilized depending on the desired range of colors to be emitted by LED lighting unit 20, or to control and optimize additional parameters such as the Color Rendering Index.

Figure 3C:
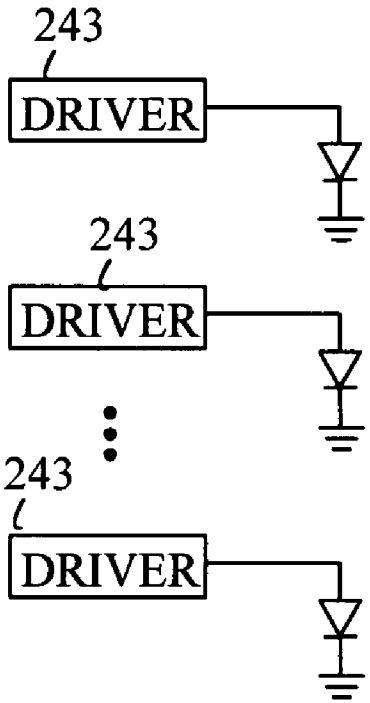
FIGS. 3A-3C are schematic drawings of the three basic drive schemes.
Figure 3B:
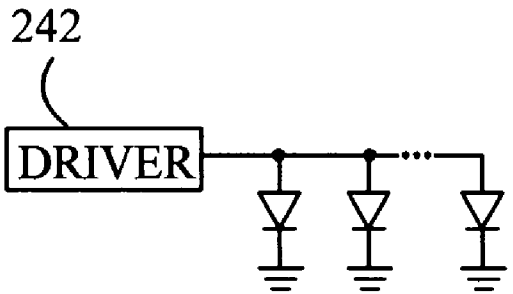
Figure 3A:
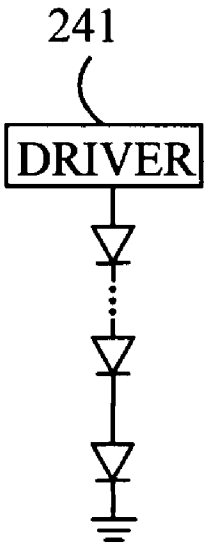

As noted above, the LEDs are grouped together into groups in which all of the LEDs emit light of the same spectrum. There are three basic driving schemes for the LEDs. Refer now to FIGS. 3A-3C, which are schematic drawings of the three basic LED drive schemes. In one scheme, all of the LEDs in a given group are connected in series as shown in FIG. 3A, and hence, each LED is driven with the same current. In this scheme, the current is controlled through a single drive circuit 241 that is under the control of controller 51 to provide the desired light output from the group. This scheme requires only one drive circuit. This scheme has a number of problems, however. If any LED fails by forming an open circuit, the light from the entire group is lost. In addition, this scheme assumes that all of the LEDs are identical, and hence, the same current is appropriate for each LED. To accommodate a spare LED, a second drive circuit that is normally "off" is required.

In the second scheme, all of the LEDs are driven in parallel as shown in FIG. 3B. This scheme also requires only one driver 242. However, if one of the LEDs fails by short-circuiting, the group is lost. In addition, this scheme assumes that a common driving potential is optimum for each LED. To accommodate a spare LED, a second drive circuit that is normally "off" is also required in this scheme.

In the third scheme, each LED is driven with a separate driver 243 and its current is separately adjusted. This scheme requires more drive circuits but allows each LED to be separately optimized. In addition, if one LED fails for any reason, the remaining LEDs in the group will continue to function normally. This scheme is particularly attractive in embodiments of the present invention in which spare LEDs are included in each group. In such embodiments, a spare LED and driver can be activated to replace the light that was lost due to the loss of the failed LED without treating the spare LEDs differently from the other LEDs. It should be noted that individual LEDs typically differ from one another even when fabricated on the same fabrication line. Hence, these embodiments can be operated such that each LED generates the same amount of light independent of the differences between the LEDs. Here, the current through each LED is adjusted such that each LED generates the same amount of light when turned on. The duty cycle of the LEDs is then adjusted to provide the desired light output from the group of LEDs when light levels that are less than this maximum level are desired.

In addition, it should be noted that LEDs age with use. Hence, as the LEDs age, the current through each LED typically needs to be increased to maintain the light output of the LED at the desired value. Here again, embodiments that utilize separate drivers are useful in correcting for aging effects that vary from LED to LED.

Figure 4:
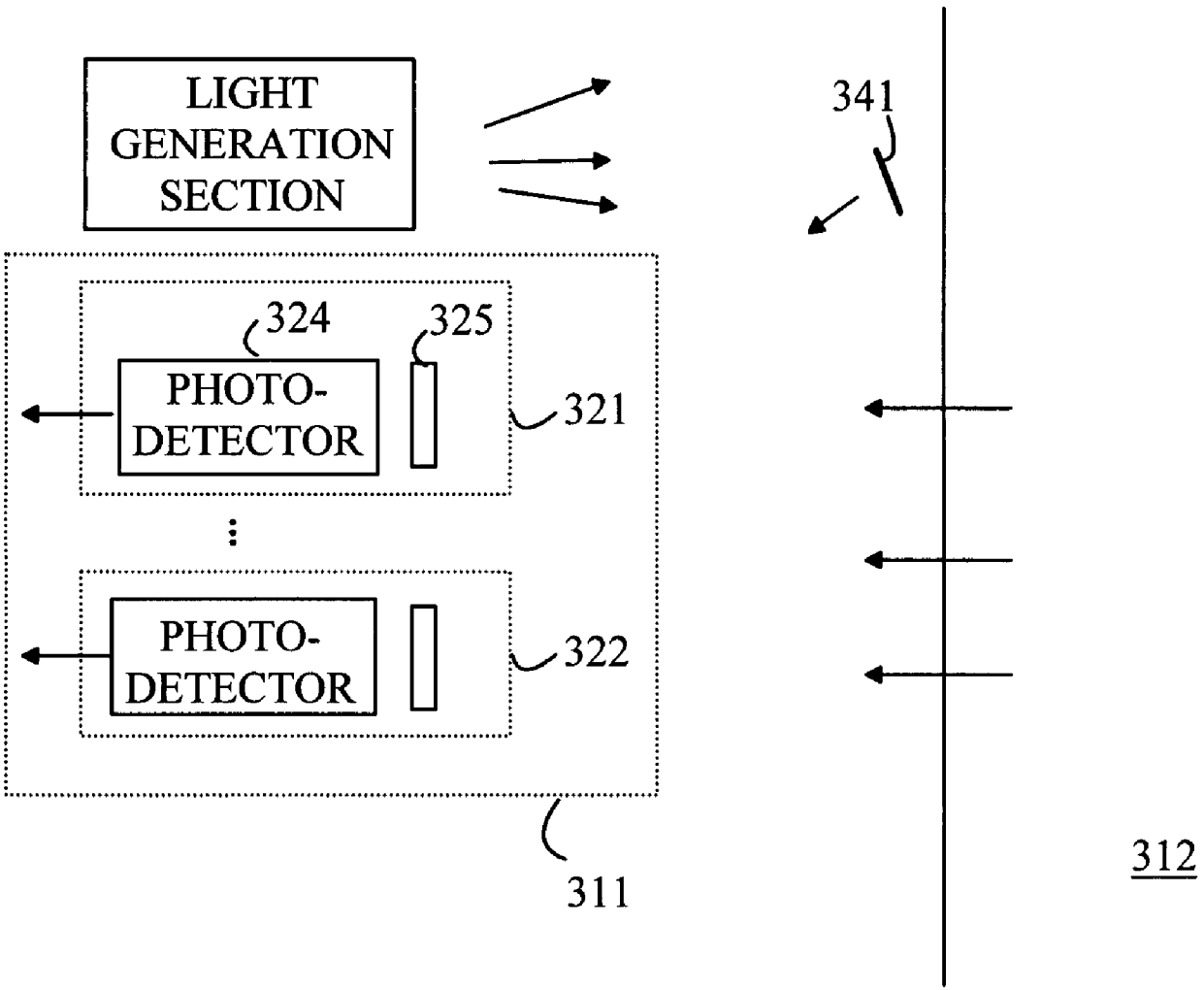
FIG. 4 illustrates a light analyzer according to one embodiment of the present invention.

To determine the correct current to use for each LED, controller 51 must be able to monitor the light produced by each LED, and optionally, monitor light from the region surrounding LED lighting unit 20. Light analyzer 31 performs this function. Refer now to FIG. 4, which illustrates one embodiment of a light analyzer according to the present invention. Light analyzer 311 measures the light emitted by each LED and also the ambient light in the room 312 in which the LED lighting unit is operating by monitoring the light reaching the light analyzer from the room when all of the LEDs are turned off.

Light analyzer 311 is constructed from a number of photodetectors in which each photodetector includes a photodiode 324 and a band pass filter 325. Exemplary photodiodes are shown at 321 and 322. Each photodiode detects light emanating from one of the groups of LEDs. In addition, one or more photodiodes are positioned to measure light emanating from the area outside of LED lighting unit 20. As an alternative a single photodiode can be used to measure all LEDs, using a time sequential scheme, similar to the one discussed below.

In addition to controlling the currents through each of the LEDs to provide a light source of a particular color, controller 51 measures the ambient light in the room, i.e., area 312 outside LED lighting unit 20. In one mode, controller 51 increases or decreases the light from LED lighting unit 20 so as to compensate for changes in the ambient light in the room. If the light originating from sources other than LED lighting unit 20 increases, controller 51 decreases the light generated by LED lighting unit 20, and vice versa, so as to maintain the light level in the room as close as possible to a particular level. It should be noted that this level can also be varied in response to other factors such as the time of day or whether or not the room is occupied. In such embodiments, controller 51 could include other hardware such as a clock and software to compute the date.

Controller 51 utilizes the outputs of these photodiodes in light analyzer 311 to determine the light originating from each LED. Since each group of LEDs includes a plurality of LEDs that emit the same spectrum, controller 51 must distinguish the light generated by each LED from that emitted by the other LEDs in the group. In one embodiment, controller 51 turns off all of the LEDs in the group except the LED currently being measured, and hence, the signal light generated by that LED could be measured separately. As noted above, the LEDs are preferably operated in a pulse mode. Since the response of the photodiodes is fast compared to the time resolution of the human eye, this calibration measurement can be accomplished without a person in the room noticing the brief period over which all but one of the LEDs in a group were turned off.

If LED lighting unit 20 is only required to adjust the intensity of ambient light in the room, a single photodiode can be utilized, since only the ambient light intensity must be measured. However, in one embodiment of the present invention, controller 51 also compensates for color shifts in the ambient light. In this case, the ambient light sensors include a plurality of photodiodes that measure the intensity of light in different spectral bands in the room and adjust both the color and intensity output of the light emitting section to compensate for any shifts in intensity and/or color in the room.

The photodiodes used to measure the ambient light must be positioned to receive light from the region outside of the light source. The photodiodes that measure the light from LEDs must likewise be positioned to sample the light emitted by the LEDs. In one embodiment, the photodiodes are positioned to receive light from outside the light source, and a mirror 341 or similar object is used to reflect a portion of the light from the LEDs into the photodiodes of the light analyzer.

LED lighting unit 20 also includes a communication interface 41. Unlike a conventional lighting unit, LED lighting unit 20 implements many features in addition to the normal "on-off" function of a light source. For example, as noted above, LED lighting unit 20 also monitors the lighting conditions in the room in which it is located and can provide varying lighting functions that depend on the time of day or other factors. In addition, the light analyzing section provides measurement of the ambient lighting conditions in the room that may be of use to a central controller or home control system. This information can be utilized by controller 51 and also by a central controller that coordinates the lighting, provided there is a plurality of such light sources, and collects data from the various light sources.

In general, communication interface 41 provides a communication path for receiving and sending information that is to be utilized by or produced by LED lighting unit 20, respectively. In this regard, controller 51 can include a unique address that identifies the particular lighting unit in which it is located. The manner in which this address is entered will be discussed in more detail below.

The interface can utilize a number of different communication paths. For example, LED lighting unit 20 is connected to power by terminals shown in FIG. 1. Schemes for sending and receiving data over the power lines within a building are well known in the arts, and hence, will not be discussed in detail here. For the purposes of the present discussion, it is sufficient to note that the information is sent and received at frequencies that are significantly above the 60 Hz power frequency, and hence, are easily distinguished from the power line oscillations. Since LED lighting unit 20 must be connected to power even without this feature, the cost of utilizing the power lines for data and command communication is relatively inexpensive and provides a convenient mechanism for communicating information between LED lighting units in different portions of a building and between such LED lighting units and a central controller.

While power line communications are convenient for communicating data between devices, communications between a person and the lighting unit require some form of interface in addition to the power lines. This can be provided by a device that plugs into the power grid in a building; however, a portable device that can be carried by user can also be utilized.

In one embodiment, LED lighting unit 20 also utilizes optical signals for communicating data and commands between a user and LED lighting unit 20. The user can use a portable signaling device 71 that translates commands entered on push buttons on signaling device 71 into optical signals that are detected by light analysis section 31. The light signals can be modulated at a particular frequency to differentiate the signals from the ambient background light. Alternatively, the light signals from device 71 could utilize a different region of the spectrum. In this case, light analysis section 31 would need to include a separate detector for these light signals.

In should be noted that LED lighting unit 20 already includes a light source and light receiver, namely the light generating section and the portion of the light analyzer that measures the ambient light, respectively. Hence, LED lighting unit 20 can transmit and receive data by generating and receiving pulsed light signals. Since the light source and light receiver are already present, the cost of implementing data communications utilizing such optical signals is relatively small. In addition, device 71 can have directional selectivity, and hence, can address one lighting unit at a time in a room having several such units. The optical communication option is particularly attractive in embodiments in which device 71 is a portable transmitter that can be carried on a key chain or the like. In such embodiments, the user points the device at the lighting unit and presses a particular button on the device. Hence, a user can turn the light on or off without having to use a light switch. This enables a number of lighting units to be placed on the same circuit and still be controlled separately. For example, the portable device can include a low power laser for transmitting the desired commands. In addition to the on and off functions, the user can adjust the light level in the room or the color of the light generated by individual LED lighting units.

Finally, the user can utilize device 71 to program controller 51. In embodiments that utilize a system controller that communicates with the individual lighting units on the power line interface, each lighting unit must be given a unique address. In conventional power line controlled devices, each device typically has some form of mechanical switch that allows the user to provide it with an address. The cost of such switches is significant. Alternatively, each device provided by the manufacturer can be programmed with a unique address. Since the number of devices manufactured is very large, the addresses are very large numbers. At some point in the system setup, the user must deal with these large addresses either by entering them into the system or by correlating a device found by the system with the physical location of the device. In either case, the process is subject to errors. The present invention avoids these by allowing the user to set the address to a value that is related to the location of the device.

In addition, the user can program controller 51 to execute other functions such as turning the light on and off at specified times of the day or on specified dates. Controller 41 could also receive signals from a motion sensor and execute a specified command when motion is detected such as turning on the lights when someone enters the room.

It should be noted that LED lighting units that have both optical and power line communication interfaces are particularly useful in automating the lighting in a home or other building. The power line interface provides a connection to a central control system or control systems that allow the status of the lighting in the entire building to displayed and controlled from one or more key locations. The optical interface provides a method for allowing an individual user to control the lighting units that are operative in the particular room in which the user is located without interfering with lighting units in other rooms and without having to move to the location of a wall switch or a central controller.

While optical and power line communications are particularly attractive, other forms of communication can also be utilized. For example, communication interface 41 could include an RF communication link 46 such as a WiFi link that is used to communicate with a local controller or a remote controller. Similarly, LED lighting unit 20 could include a hardwired communication port 45 of the type used in wired Ethernet networks or the like. Additionally, an acoustic communication scheme could also be employed by including a microphone and sonic transducer within the communications interface.

The light analysis functions of the present invention can be utilized to provide other useful information if the photodetectors are selectively sensitive in other wavelength bands. For example, if one of the ambient light sensors measures light in the infrared, LED lighting unit 20 can also provide information as to the temperature in the area surrounding LED lighting unit 20. Such a function could provide a form of fire detection.

In addition, the light generation and light analysis functions can be utilized to provide a smoke detection function. The light generated by the light generation section can be distinguished from the ambient light outside of the LED lighting unit by modulating the light generated in the LED lighting unit at a predetermined frequency and detecting the portion of the output of the appropriate photodetectors at the modulation frequency. If the area outside of the light source fills with smoke, a much higher fraction of the light generated in the light generation section will be reflected back into the light analyzer than in the case in which that area is not filled with smoke. Hence, controller 51 can provide a smoke detection function. The results of the smoke detection could be forwarded to a central controller that generates an alarm.

The above-described smoke detection function is only operative when light-generating section 21 is generating light. However, by including an additional LED that generates light in the infrared and is pulsed all of the time, this function can be provided when the light generation section is not generating light in the visible region.

The above-described embodiments of the present invention utilize photodetectors based on photodiodes. However, other forms of photodetector could be utilized such as phototransistors.

Various modifications to the present invention will become apparent to those skilled in the art from the foregoing description and accompanying drawings. Accordingly, the present invention is to be limited solely by the scope of the following claims.

What is claimed is:

1. A lighting unit comprising:

a light generating section comprising a plurality of groups of LEDs, each group emitting light of a different spectrum than said other groups, one of said groups including a plurality of LEDs;

a light analysis section that generates a plurality of group intensity signals, each of said plurality of group intensity signals being based on the intensity of light generated by one of said groups;

a controller that adjusts a current through each of said LEDs in response to said group intensity signals;

a housing having a transparent window, said light generation section and said light analysis section being within said housing;

a first communication interface that said controller utilizes to communicate with a device external to said lighting unit for receiving commands during the operation of said lighting unit;

wherein said light analysis section also generates an ambient intensity signal based on the intensity of light in different spectral bands originating from a location outside of said housing; and wherein one of said groups comprises a spare LED that emits light in said spectrum of that group and wherein said controller detects an LED that is defective in that group and causes said spare LED to be connected in place of said defective LED.

2. The lighting unit of claim 1 wherein said controller alters said current through one of said LEDs in response to a change in said ambient intensity signal.

3. The lighting unit of claim 1 wherein said controller sends information on said first communications interface specifying said ambient light intensity signal.

4. The lighting unit of claim 1 wherein said first communication interface comprises a detector for receiving light signals from outside said housing.

5. The lighting unit of claim 4 further comprising a power interface for powering said lighting unit from an external power source and a second communication interface, said second communication interface comprising a transmitter and receiver for receiving said signal over said power interface.

6. The lighting unit of claim 5 wherein said light signals include information specifying an address for said lighting unit, said controller responding to commands directed to that address that are received on said second communication interface.

7. The lighting unit of claim 1 further comprising a power interface for powering said lighting unit from an external power source, said first communication interface comprising a transmitter and receiver for receiving a signal over said power interface.

8. The lighting unit of claim 1 wherein said first communication interface comprises a transmitter and receiver for sending and receiving RF signals, respectively.

9. The lighting unit of claim 1 wherein said light analysis section further comprises an infrared detector that generates a signal indicative of light in the infrared portion of the optical spectrum received from outside of said enclosure.

10. A lighting unit comprising:

a light generating section comprising a plurality of groups of LEDs, each group emitting light of a different spectrum than said other groups, one of said groups including a plurality of LEDs;

a light analysis section that generates a plurality of group intensity signals, each of said plurality of group intensity signals being based on the intensity of light generated by one of said groups;

a controller that adjusts a current through each of said LEDs in response to said group intensity signals;

a housing having a transparent window, said light generation section and said light analysis section being within said housing;

a first communication interface that said controller utilizes to communicate with a device external to said lighting unit for receiving commands during the operation of said lighting unit;

wherein said light analysis section also generates an ambient intensity signal based on the intensity of light originating from a location outside of said housing; and wherein one of said groups comprises a spare LED that emits light in said spectrum of that group and wherein said controller detects an LED that is defective in that group and causes said spare LED to be connected in place of said defective LED.

11. The lighting unit of claim 10 wherein said controller alters said current through one of said LEDs in response to a change in said ambient intensity signal.

12. The lighting unit of claim 10 wherein said controller sends information on said first communications interface specifying said ambient light intensity signal.

13. The lighting unit of claim 10 wherein said first communication interface comprises a detector for receiving light signals from outside said housing.

14. The lighting unit of claim 13 further comprising a power interface for powering said lighting unit from an external power source and a second communication interface, said second communication interface comprising a transmitter and receiver for receiving said signal over said power interface.

15. The lighting unit of claim 10 wherein said light analysis section further comprises an infrared detector that generates a signal indicative of light in the infrared portion of the optical spectrum received from outside of said enclosure.

16. The lighting unit of claim 10 further comprising a power interface for powering said lighting unit from an external power source, said first communication interface comprising a transmitter and receiver for receiving a signal over said power interface.

17. The lighting unit of claim 10 wherein said first communication interface comprises a transmitter and receiver for sending and receiving RF signals, respectively.

18. The lighting unit of claim 14 wherein said light signals include information specifying an address for said lighting unit, said controller responding to commands directed to that address that are received on said second communication interface.

* * * * *